US012092416B1

(12) United States Patent
Schumacher

(10) Patent No.: US 12,092,416 B1
(45) Date of Patent: Sep. 17, 2024

(54) DELAYED BLOWBACK DEVICE

(71) Applicant: Theodore R. Schumacher, Albany, WI (US)

(72) Inventor: Theodore R. Schumacher, Albany, WI (US)

( * ) Notice: Subject to any disclaimer, the term of this patent is extended or adjusted under 35 U.S.C. 154(b) by 57 days.

(21) Appl. No.: 18/116,377

(22) Filed: Mar. 2, 2023

Related U.S. Application Data

(60) Provisional application No. 63/320,287, filed on Mar. 16, 2022.

(51) Int. Cl.
*F41A 3/38* (2006.01)
*F41A 19/30* (2006.01)

(52) U.S. Cl.
CPC ..... *F41A 3/38* (2013.01); *F41A 19/30* (2013.01)

(58) Field of Classification Search
CPC ..... F41A 3/36; F41A 3/38; F41A 3/40; F41A 3/44; F41A 3/46
USPC ..... 89/173, 187.02, 180–190
See application file for complete search history.

(56) References Cited

U.S. PATENT DOCUMENTS 3,283,435 A 11/1966 Koch
4,922,640 A * 5/1990 Toombs ..... F41B 11/00 42/16
4,934,081 A * 6/1990 Mooney ..... F41C 3/14 42/62
5,900,576 A * 5/1999 Gabriel ..... F41A 3/46 89/187.01
6,715,399 B2 * 4/2004 Barrett, Jr. ..... F41A 3/46 89/182
7,156,084 B1 * 1/2007 Landis ..... F41A 9/38 124/50
7,299,737 B2 * 11/2007 Hajjar ..... F41A 3/46 89/188
7,571,671 B2 * 8/2009 Engel ..... F41A 5/16 89/174
7,770,507 B1 * 8/2010 Hajjar ..... F41A 3/46 89/188
8,807,010 B2 * 8/2014 Bubits ..... F41A 21/488 89/187.01
9,964,369 B2 * 5/2018 Garrow ..... F41A 3/44
10,788,277 B2 * 9/2020 Kolev ..... F41A 3/72
10,557,673 B2 11/2020 Overstreet et al.
11,371,789 B2 * 6/2022 Underwood ..... F41A 3/46
11,543,195 B2 * 1/2023 Underwood ..... F41A 3/62
2007/0012170 A1 * 1/2007 Spielberger ..... F41A 3/40 89/196

(Continued)

*Primary Examiner* — Jonathan C Weber
(74) *Attorney, Agent, or Firm* — Donald J. Ersler

(57) ABSTRACT

A delayed blowback device preferably includes a bolt, a gas key and at least one spring-loaded projection. A projection slot or projection pocket traverses a bottom of the gas key, which are sized to receive a width of the spring-loaded projection. The spring-loaded projection could have a round outer perimeter or a D-shaped outer perimeter. A location of the projection slot along a length of the gas key is such that the projection contacts a cam pocket in an inner wall of an upper receiver. In a second embodiment, a slide stop in a bottom of the gas key is used to push a projection into the cam pocket. Spring rates may be varied to increase or decrease the firing rate of the firearm. The return speed of the bolt carrier could also be modified by changing a distance between the projection pocket and a rear of the bolt.

14 Claims, 14 Drawing Sheets

(56) References Cited

U.S. PATENT DOCUMENTS

| | | | | |
|---|---|---|---|---|
| 2016/0252316 | A1* | 9/2016 | Garrow | F41A 19/30 89/181 |
| 2017/0122685 | A1* | 5/2017 | Kolev | F41A 17/46 |
| 2022/0163277 | A1* | 5/2022 | Dere | F41A 3/46 |

* cited by examiner

DELAYED BLOWBACK DEVICE

CROSS-REFERENCES TO RELATED APPLICATIONS

This is a non-provisional patent application which claims the benefit of patent application No. 63/320,287, filed on Mar. 16, 2022.

BACKGROUND OF THE INVENTION

Field of the Invention

The present invention relates generally to firearms and more specifically to a delayed blowback device, which is suitable for application in AR15 type rifles chambered in pistol calibers.

Discussion of the Prior Art

AR15 type rifles chambered as pistol calibers are often called AR9s or pistol caliber carbines (PCC). They are chambered in 9 MM, 40 cal, 45ACP, 10 MM and other similar calibers normally found in handguns. Currently there are 3 main operating systems for PCCs. A first main operating system is known as direct blowback, blowback, straight blowback or traditional blowback. The direct blowback uses heavy Bolt Carrier Groups (BCGs) with added internal weights, heavy buffers, and springs to slow down the BCG, after the cartridge's explosion forces the BCG reward to extract the spent ammo cartridge (case) and load the next round. With direct blowback, the bullet is held in the chamber with nothing more than spring pressure and the heavy BCG. The direct blowback system is designed to be extremely reliable and affordable to manufacture, the down side is increased recoil and a heavier firearm with the additional weight to slow down the BCG. The blowback pistol caliber bolt is often referred to as a BCG, even though it looks a lot different than an AR15 rifle caliber BCG, which has a separate bolt and carrier.

A second operating system used in AR style PCCs is radial delayed blowback. The radial delayed blowback uses a BCG that looks similar to an AR15 BCG and has a separate bolt and carrier. The difference between an AR15 rifle caliber BCG and a radial delayed blowback BCG is that the radial delayed blowback BCG is for pistol calibers. The lugs on the back side of the bolt are chamfered to allow the bolt to unlock from a chamber after a round is fired. A gas key on top of the carrier keeps the carrier vertically aligned in the upper receiver. The benefit of the radial delayed blowback design is reduced recoil as the bolt has to unlock from the breach, which slows down inertia and provides lighter blowback. The downside to the radial delayed blowback is greater expense to produce the BCG and barrel compared to direct blowback bolts and barrels, U.S. Pat. No. 10,557,673 to Overstreet et al. discloses a radial delayed blowback operating system such as for AR 15 platform.

The third operating system used in AR style PCCs is the roller delayed blowback system. The roller delayed blowback system is similar to HK MP5 firearms. The roller delayed blowback system uses rollers that lock the bolt to the barrel until enough pressure has exited the firearm through the barrel. After that point, the rollers slide into a cavity in the bolt and safely travel rearward with the remaining recoil absorbed by an operating spring. Like the radial delayed blowback system, these PCCs have less felt recoil and they can be lighter in weight than blowback PCC.

They are also more expensive to manufacture with extra parts, tighter tolerances, and different barrel cuts. U.S. Pat. No. 3,283,435 to Koch, discloses a breech closure.

It appears that the prior art does not teach or suggest a delayed blowback device, which would use a direct blowback barrel, bolt, gas key and a spring-loaded projection. The spring-loaded projection is retained in the gas key. The gas key is attached to a top of the bolt. However, the spring-loaded projection could be retained on a top of the direct blowback barrel bolt, which would eliminate the need for the gas key. Most AR15/AR9 upper receivers are interchangeable and most have an internal pocket (cam pocket) to allow a cam pin of a bolt carrier group (BCG) to rotate to a side when the bolt unlocks in rifle caliber ARs and the radial delayed blowback BCG. The cam pocket is a half-circle slot. The cam pocket will act as a locking point for the spring-loaded projection when the bolt is in battery. When a round is fired, the spring-loaded projection inside the upper receiver cam pocket will delay or resist rearward movement of the bolt. The delay can be increased or decreased by choosing a stronger or weaker spring. The delay can be used to increase the amount of time to eject the spent cartridge and load a new round. When the bolt returns to battery the spring-loaded projection slides back into the cam pocket applying pressure to the rear surface of the cam pocket and locking the bolt in a forward position.

Accordingly, there is a clearly felt need in the art for a delayed blowback device, which is suitable for application in AR15 type riles chambered in pistol calibers, and which allows the time between firing rounds to be varied by changing a spring.

SUMMARY OF THE INVENTION

The present invention provides a delayed blowback device, which allows the time between firing rounds to be varied. The delayed blowback device preferably includes a bolt, a gas key and a spring-loaded projection. A projection slot traverses a bottom of the gas key. The projection slot is sized to slidably receive a width of the spring-loaded projection. The projection slot includes a pair of retention lips at an opening to axially retained the spring-loaded projection. However, the spring-loaded projection could be retained on a top of the bolt, which would eliminate the need for the gas key. The spring-loaded projection preferably has a round outer perimeter or a D-shaped outer perimeter. If the projection has a round outer perimeter, it is preferable to use a leaf spring to exert outward force on the round projection. A standoff surface is preferably formed on a bottom of the round projection to allow the outer perimeter of the projection to extend above a slot formed in a top of the bolt. A leaf spring pocket is formed adjacent to a side of the gas key and substantially perpendicular to an axis of the projection slot. A threaded tap is formed in the gas key, parallel to the axis of the projection slot. A set screw would be tightened against the leaf spring to retain the leaf spring in the leaf spring pocket. However, the set screw could be eliminated by making the leaf spring pocket tight fitting. The leaf spring pocket is capable of receiving different spring rates of leaf springs for varying the return speed of the bolt carrier during firing.

If the projection has a D-shaped outer perimeter, it is preferably to use a compression spring to exert outward force on the D-shaped projection. A standoff surface is preferably formed on a bottom of the D-shaped projection to allow the outer perimeter of the projection to extend above a slot formed in the bolt. A spring hole is preferably formed in rear of the D-shaped projection to receive the compression spring. Compression springs with different spring rates may be inserted into the spring hole for varying the return speed of the bolt carrier during firing. Once the round projection or D-shaped projection is installed in the bottom of the gas key, the gas key is secured to the bolt with fasteners or any other suitable attachment method.

A location of the projection slot on the gas key is such that the round projection or D-shaped projection contacts a rear of a cam pocket in an inner sidewall of the upper receiver when the bolt is at rest. To decrease the speed of fire, the leaf or compression spring is replaced with a stronger spring. To increase the speed of fire, the leaf or compression spring is replaced with a weaker spring. The return speed of the bolt carrier could also be modified by changing a distance between the projection slot and the fasteners. Decreasing the distance between the projection slot and the fasteners will increase firing speed. Increasing the distance between the projection slot and the fasteners will decrease firing speed. A second D-shaped projection may be retained in the gas key. The second D-shaped projection increases friction with the charging handle channel with the result of slowing down the bolt, before the bolt loads another round and returns to battery.

In an alternative embodiment, the spring is replaced with a slide stop. A slide stop slot is formed in a bottom of the gas key to axially support a sliding motion of the slide stop. An angled surface is formed on one end of the slide stop, which contacts an outer perimeter of the round projection. An opposing end of the slide stop is in contact with an end of the barrel. When the bolt moves forward relative to the barrel, the slide stop is pushed backward in the slide stop slot and the angled surface forces the round projection into the cam pocket in an inner sidewall of the upper receiver.

Accordingly, it is an object of the present invention to provide a delayed blowback device, which is suitable for application in AR15 type rifles chambered in pistol calibers.

It is further object of the present invention to provide a delayed blowback device, which allows the time between firing rounds to be varied by changing a spring.

Finally, it is another object of the present invention to provide a delayed blowback device, which allows the time between firing rounds to be varied by utilizing a slide stop and a round projection.

These and additional objects, advantages, features and benefits of the present invention will become apparent from the following specification.

DETAILED DESCRIPTION OF THE PREFERRED EMBODIMENTS

Figure 1:
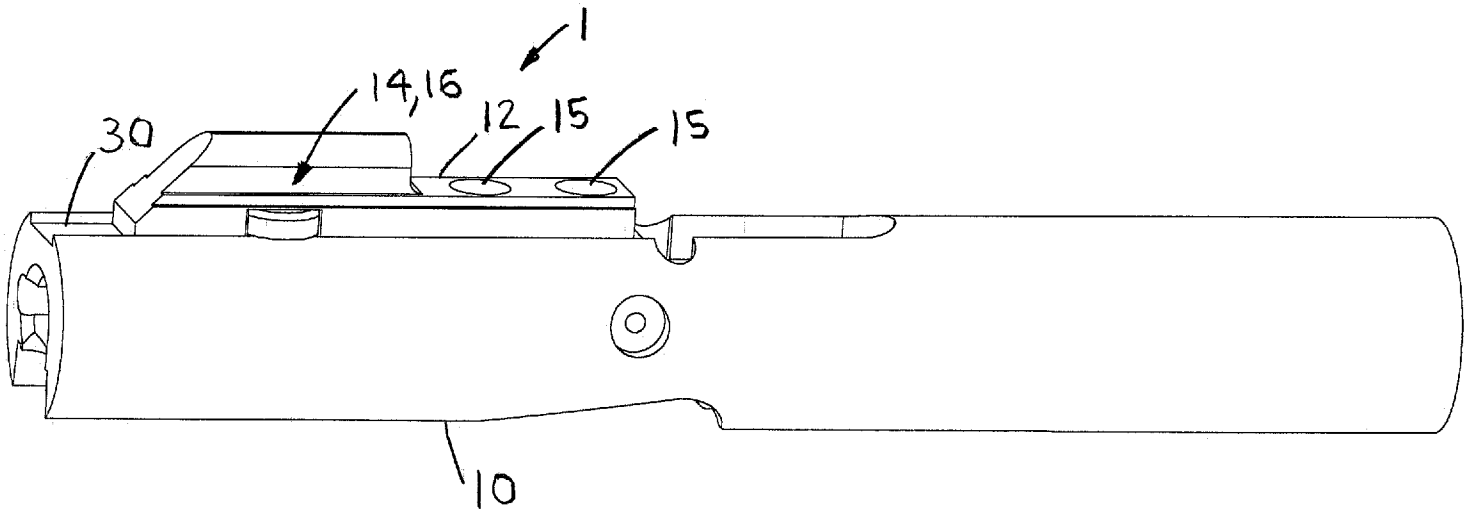
FIG. 1 is a side view of a delayed blowback device in accordance with the present invention.
Figure 2:
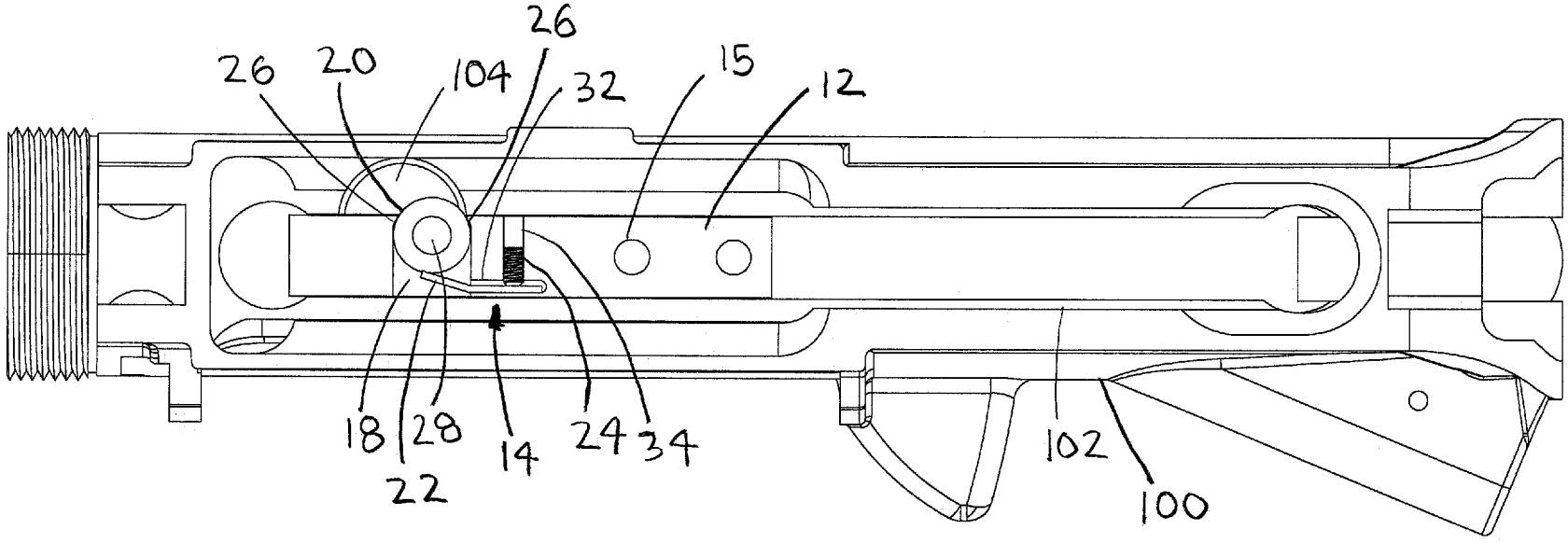
FIG. 2 is a bottom view of an upper receiver with a gas key including a round spring-loaded projection retained in charging handle channel of a delayed blowback device in accordance with the present invention.
Figure 3:
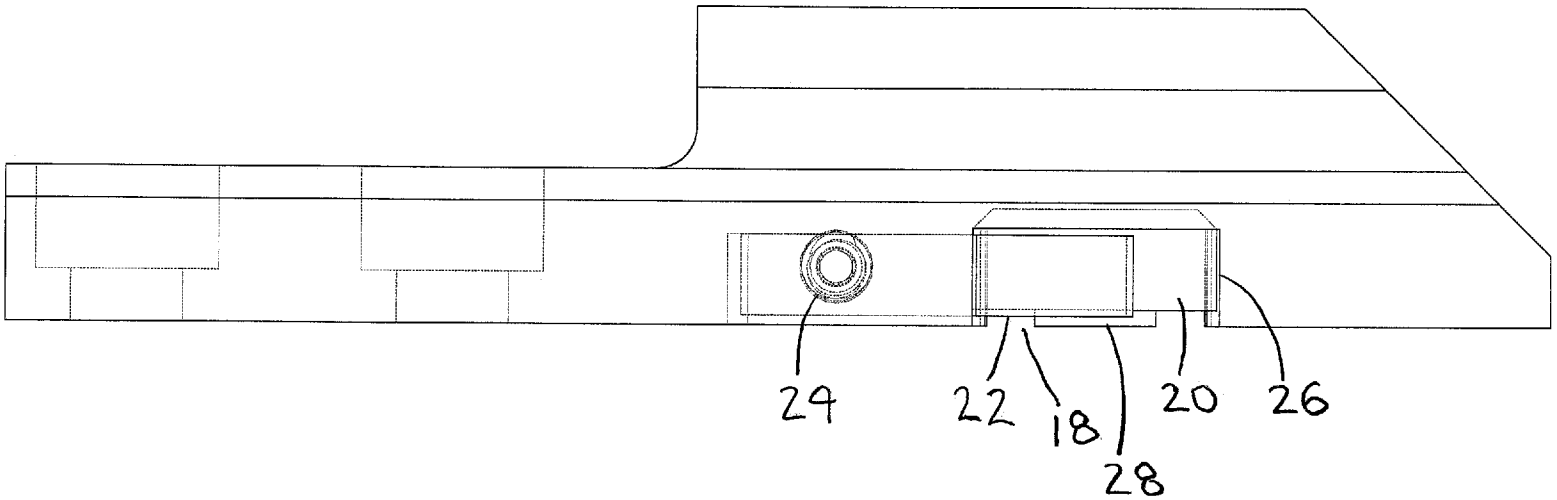
FIG. 3 is an enlarged side view of a gas key of a delayed blowback device with a round spring-loaded projection in accordance with the present invention.

With reference now to the drawings, and particularly to FIG. 1, there is shown a delayed blowback device 1. The delayed blowback device 1 preferably includes a bolt 10, a gas key 12 and a spring-loaded projection 14, 16. The gas key 12 is preferably attached to the bolt 10 with a pair of fasteners 15. However, the gas key 12 and the bolt 10 could be fabricated from a single piece of material. With reference to FIGS. 2-3, a projection slot 18 traverses a bottom of the gas key 12. FIG. 2 shows a bottom view of an upper receiver 100 with the gas key 12 retained in a channel 102. The projection slot 18 is sized to receive a width of the spring-loaded projection 14. The spring-loaded projection 14 preferably includes a round projection 20, a leaf spring 22 and a set-screw 24. The projection slot 18 includes a pair of retention lips 26 at an opening to axially retain the round projection 20.

A standoff surface 28 is preferably formed on a bottom of the round projection 20 to allow the outer perimeter to extend above a gas key slot 30 formed in a top of the bolt 10. However, some bolts include a flat top surface. A leaf spring pocket 32 would be formed adjacent a side of the gas key 12 and substantially perpendicular to a lengthwise axis of the projection slot 18. A threaded tap 34 is formed in the gas key 12, parallel to a lengthwise axis of the projection slot 18. A set screw 24 would be tightened against the leaf spring 22 to retain the leaf spring 22 in the leaf spring pocket 32. However, the set screw 24 could be eliminated by making the leaf spring pocket 32 tight fitting. The leaf spring pocket 32 is capable of receiving different strength leaf springs for varying the return speed of a bolt carrier during firing of an AR pistol.

Figure 4:
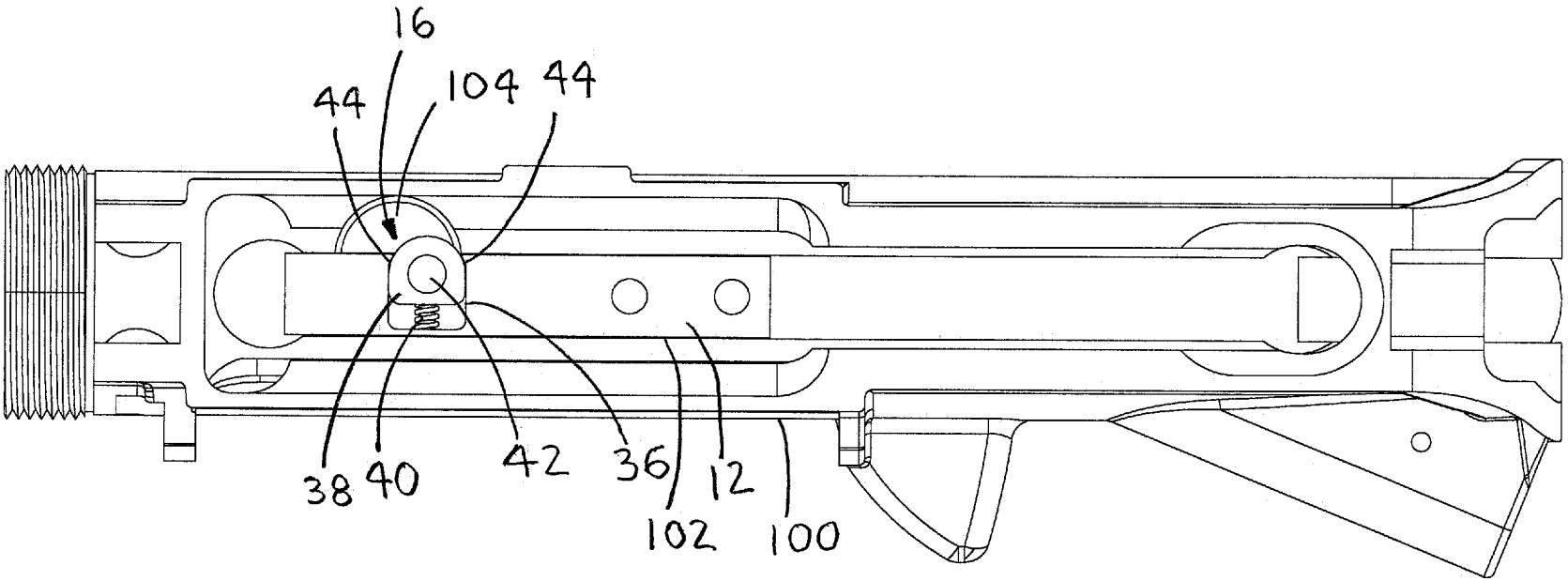
FIG. 4 is a bottom view of an upper receiver with a gas key including a D-shaped projection retained in charging handle channel of a delayed blowback device in accordance with the present invention.
Figure 5:
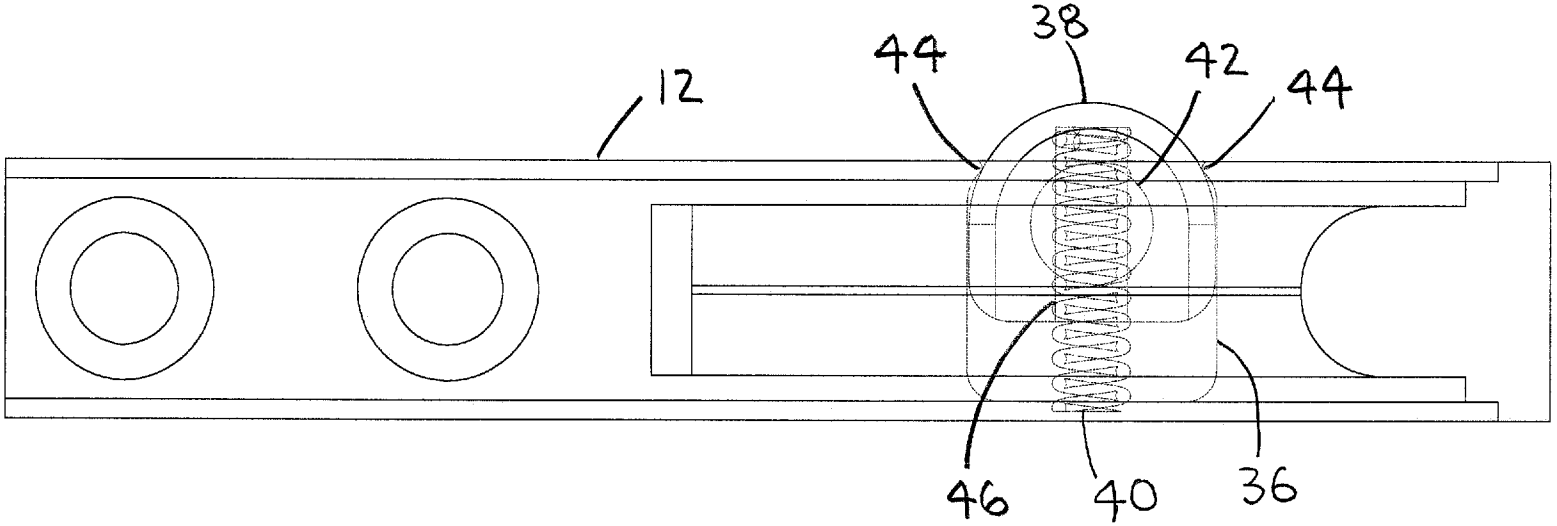
FIG. 5 is an enlarged bottom view of a gas key having a spring-loaded D-shaped projection, illustrating a compression spring retained in the D-shaped projection of a delayed blowback device in accordance with the present invention.
Figure 6:
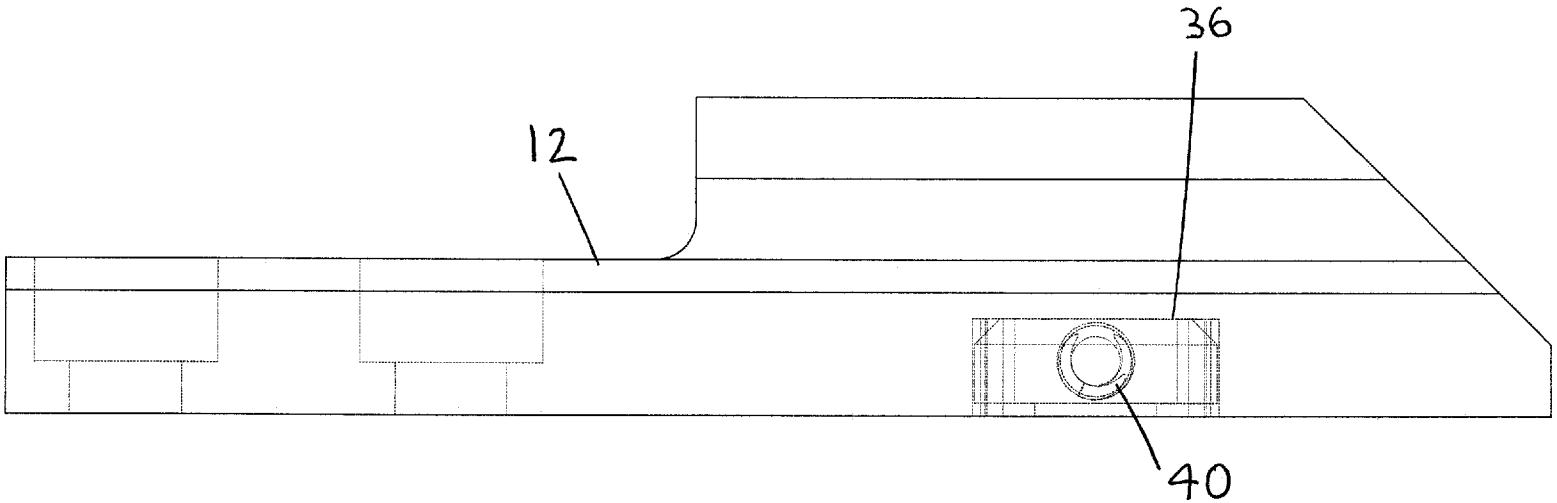
FIG. 6 is an enlarged side view of a gas key having a spring-loaded D-shaped projection illustrating a compression spring retained in the D-shaped projection of a delayed blowback device in accordance with the present invention.

With reference to FIG. 4, a projection pocket 36 is formed in a bottom of the gas key 12. The spring-loaded projection 16 preferably includes a D-shaped projection 38 and a compression spring 40. A standoff surface 42 is preferably formed on a bottom of the D-shaped projection 38 to allow the outer perimeter to extend above a gas key slot 30 formed in a top of the bolt 10. The projection pocket 36 includes a pair of retention lips 44 at an opening to axially retain the D-shaped projection 38. With reference to FIG. 5, a spring hole 46 is preferably formed in rear of the D-shaped projection to receive the compression spring 40. A compression spring with different spring rates may be inserted into the spring hole 46 for varying the return speed of the bolt carrier during firing of the AR pistol.

After the D-shaped projection 38 is installed in the projection pocket 36 of the gas key 12, the gas key 12 is secured to the bolt 10 with fasteners 15 or any other suitable attachment method. The return speed of the bolt carrier could also be modified by changing a distance between the projection slot 18/the projection pocket 36 and the fasteners 15. Decreasing the distance between the projection slot 18, the projection pocket 36 and the fasteners 15 will increase firing speed. Increasing the distance between the projection slot 18, the projection pocket 36 and the fasteners 15 will decrease firing speed.

A location of the projection slot 18 or the projection pocket 36 along a lengthwise axis of the gas key 12 is such that the projection 20, 38 makes contact with a rear of a cam pocket 104 in an inner sidewall of the upper receiver 100, when the bolt 10 is at rest. To decrease the rate of fire, the leaf or compression spring 22, 40 is replaced with a stronger spring. To increase the rate of fire, the leaf or compression spring 22, 40 is replaced with a weaker spring.

Figure 7:
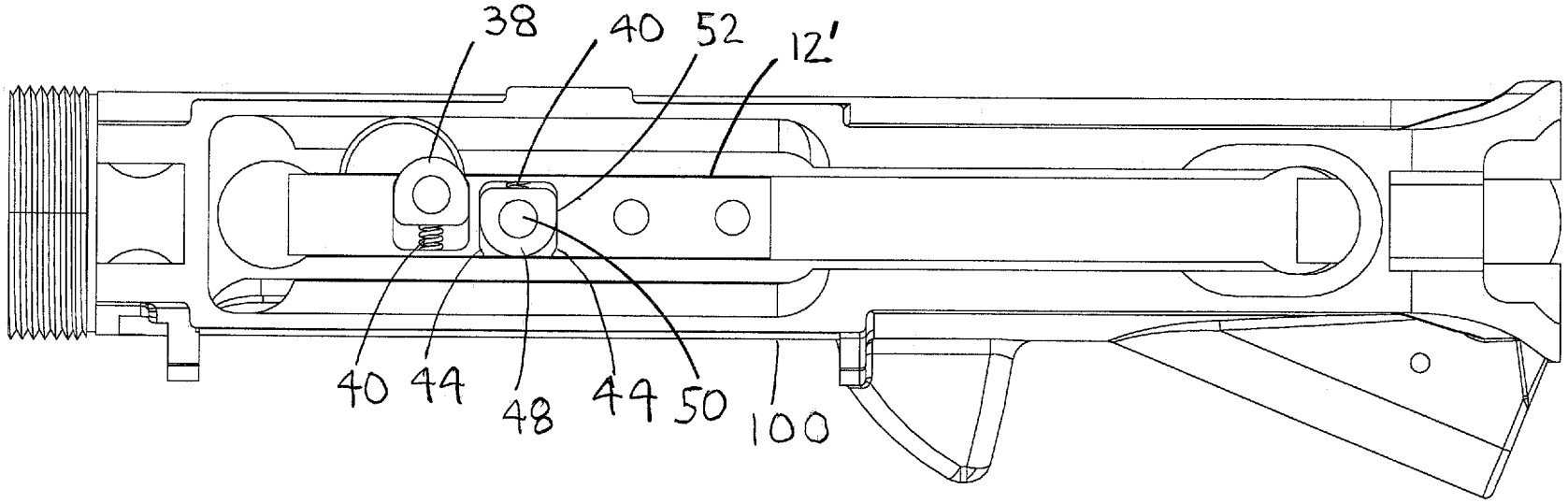
FIG. 7 is a bottom view of an upper receiver with a gas key including two D-shaped projections retained in a charging handle channel of a delayed blowback device in accordance with the present invention.
Figure 8:
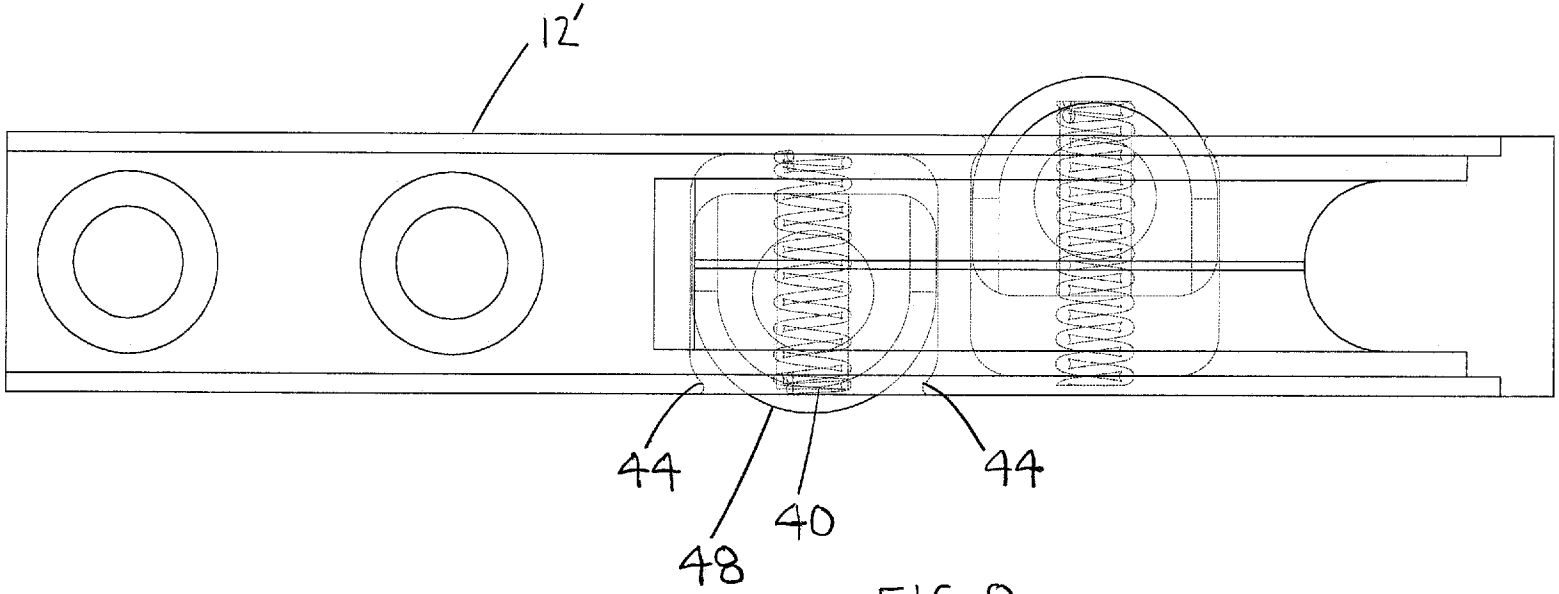
FIG. 8 is an enlarged bottom view of a gas key having two spring-loaded D-shaped projections, illustrating two compression springs retained in the two D-shaped projections of a delayed blowback device in accordance with the present invention.
Figure 9:
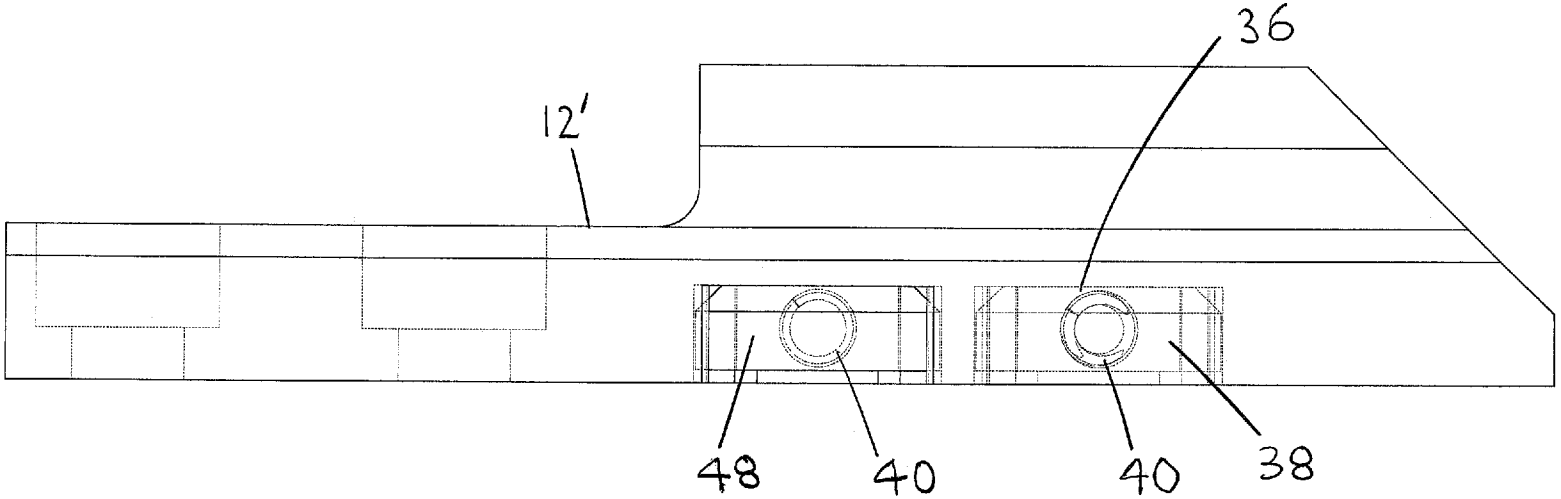
FIG. 9 is an enlarged side view of a gas key having two spring-loaded D-shaped projections illustrating two compression springs retained in the two D-shaped projections of a delayed blowback device in accordance with the present invention.
Figure 10:
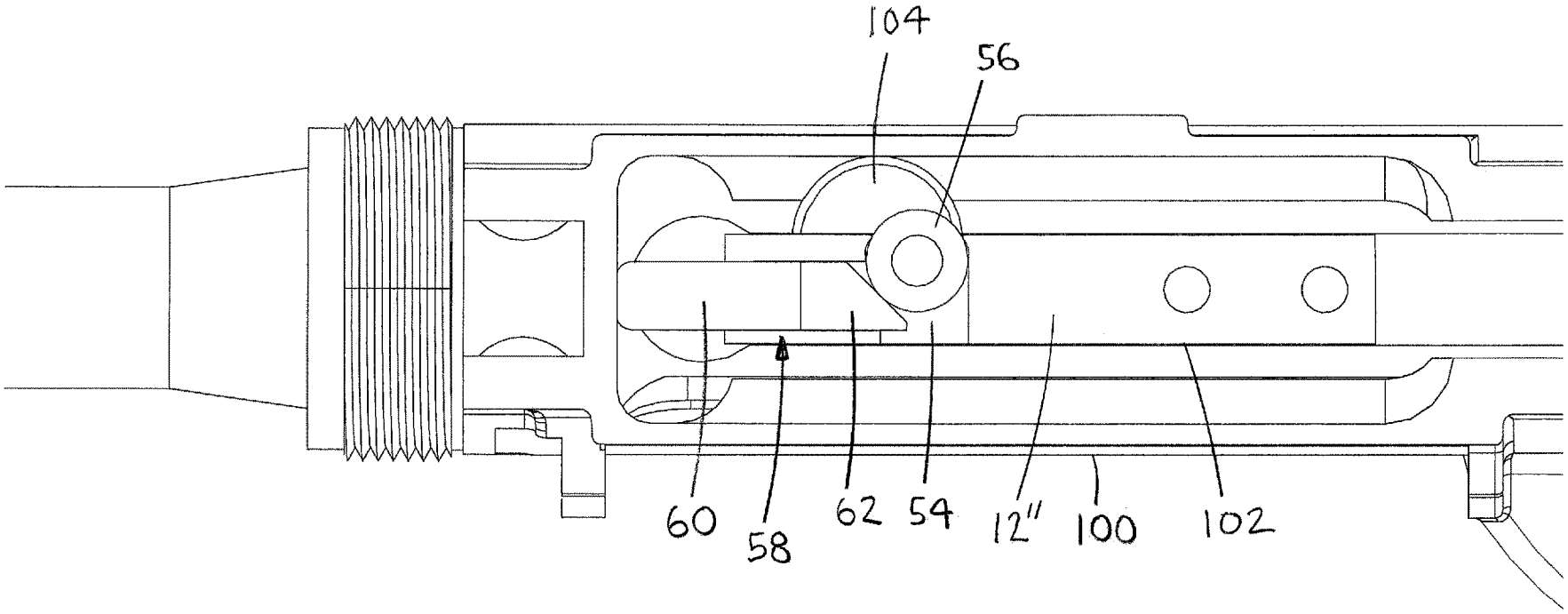
FIG. 10 is a bottom view of an upper receiver with a gas key including a round projection in contact with a slide stop in a charging handle channel of a delayed blowback device in accordance with the present invention.
Figure 11:
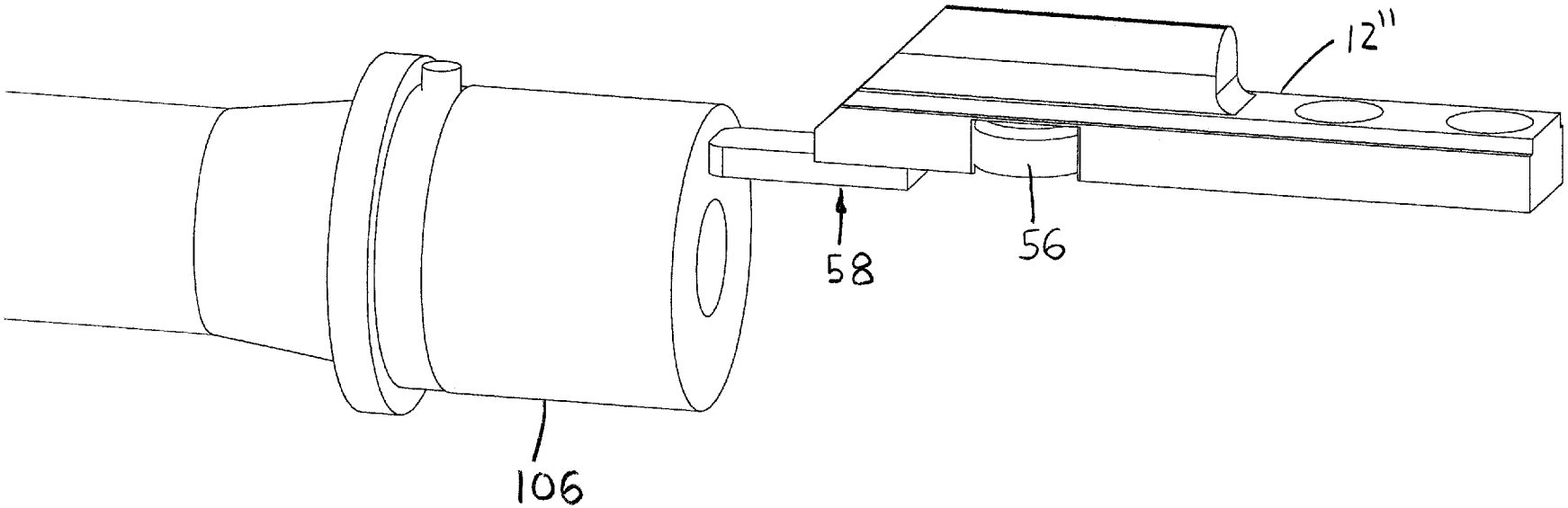
FIG. 11 is a perspective view of a slide stop and a round projection retained in a gas key and an end of the slide stop in contact with a barrel of a delayed blowback device in accordance with the present invention.
Figure 12:
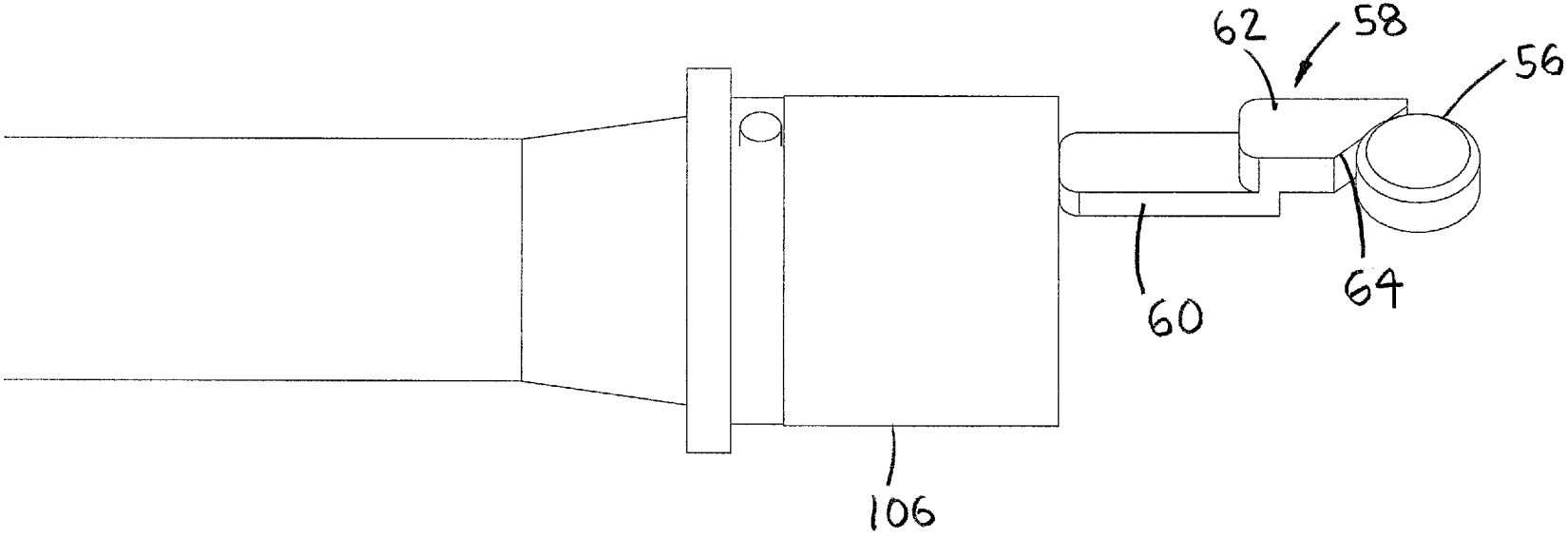
FIG. 12 is a perspective view of a slide stop having one end in contact with a round projection and an opposing end in contact with a barrel, after a gas key has been removed of a delayed blowback device in accordance with the present invention.
Figure 13:
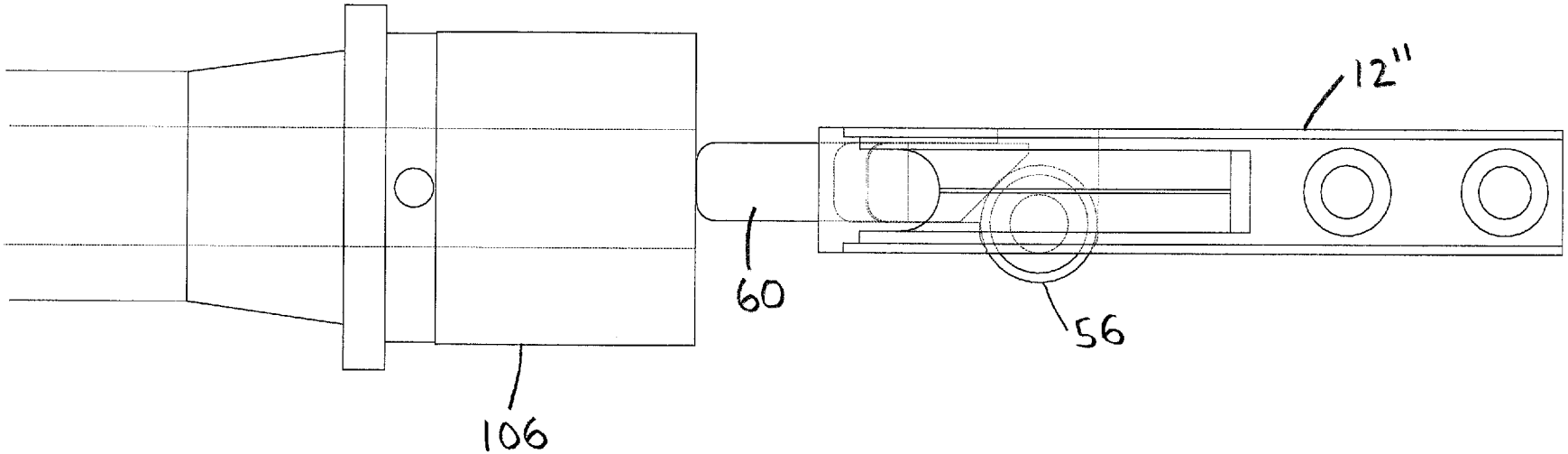
FIG. 13 is a top view of a slide stop and a round projection retained in a gas key and an end of the slide stop in contact with a barrel of a delayed blowback device in accordance with the present invention.
Figure 14:
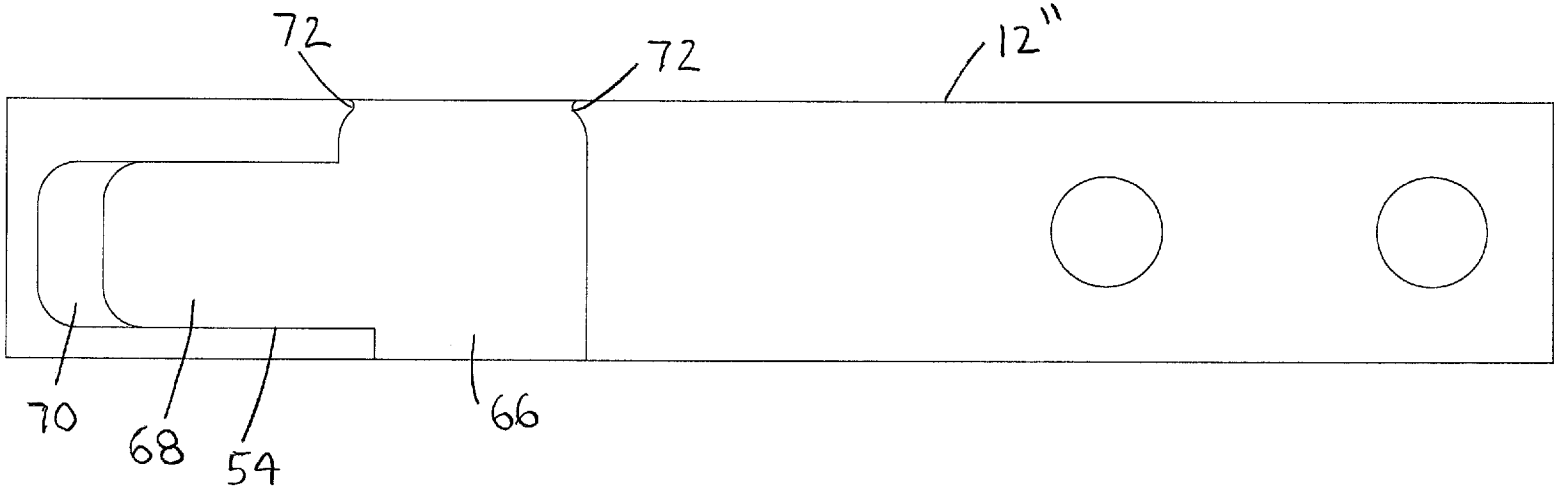
FIG. 14 is a bottom view of a gas key with a slide stop and a round projection removed of a delayed blowback device in accordance with the present invention.

With reference to FIGS. 7-9, a gas key 12' includes a second D-shaped projection 48. A standoff surface 50 is preferably formed on a bottom of the second D-shaped projection 48 to allow the outer perimeter to extend above the gas key slot 30 formed in the top of the bolt 10. A second projection pocket 52 is formed in a bottom of the gas key 12' to slidably retained the second D-shaped projection 48. The second projection pocket 52 includes a pair of retention lips 44 at an opening to axially retain the second D-shaped projection 48. A second compression spring 40 is used to bias the second D-shaped projection 48 outward from the gas key 12'. The second D-shaped projection 48 increases friction relative to the charging handle channel 102 with the result of slowing down the bolt 10, before the bolt 10 loads another round and returns to battery.

With reference to FIGS. 10-14, a projection pocket 54 is formed in a bottom of a gas key 12" to receive a round projection 56 and a slid stop 58. The slide stop 58 preferably includes a base portion 60 and a projection portion 62. A bottom of the projection portion 62 extends forward from a top of the base portion 60. An angled surface 64 is formed on a front of the projection portion 60 to contact an outer perimeter of the round projection 56. The projection pocket 54 includes a projection area 66 and a slide area 68. The projection area 66 traverses a width of the gas key 12" and is sized to receive the round projection 56. The slide area 68 intersects the projection area 66 and includes an axis, which is parallel to a lengthwise axis of the gas key 12". The slide area 68 axially supports a sliding motion of the slide stop 58. A portion of a depth of the slide area 68 has a reduced depth 70 to support a top of the projection portion 62. One end of the projection area 66 includes a pair of retention lips 72 for retaining the round projection 56. An opposing end of the slide stop 58 is in contact with an end of the barrel 106.

When the bolt 10 moves forward relative to the barrel 106, with the gas key 12" attached to a top of the bolt 10 (shown in FIG. 1), the slide stop 58 is pushed backward in the slide area 68 of the projection pocket 54 and the angled surface 64 forces the round projection 56 into the cam pocket 104 in an inner sidewall of the upper receiver 100.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A delayed blowback device for a firearm, the firearm including an upper receiver, a charging handle channel is formed in the upper receiver, a cam pocket is formed in the upper receiver and communicates with the charging handle channel, comprising:

at least one projection, one of said at least one projection makes contact with a wall of the cam pocket;

a gas key includes at least one projection pocket formed therein, said at least one projection pocket is sized to slidably receive said at least one projection; and at least one biasing device forces said at least one projection beyond a side of said gas key, wherein said gas key is slidably retained in said charging handle channel.

2. The delayed blowback device of claim 1 wherein:

said at least one projection has a round shape.

3. The delayed blowback device of claim 1 wherein:

said at least one biasing device is a leaf spring.

4. The delayed blowback device of claim 3 wherein:

a threaded hole is formed in said gas key to threadably receive a threaded fastener, said threaded fastener is used to retain said leaf spring.

5. The delayed blowback device of claim 1 wherein:

said at least one projection has a D-shape.

6. The delayed blowback device of claim 5 wherein:

said at least one biasing device is a compression spring.

7. The delayed blowback device of claim 6 wherein:

a hole is formed in each one of said at least one projection to receive said compression spring.

8. A delayed blowback device for a firearm, the firearm including an upper receiver, a charging handle channel is formed in the upper receiver, a cam pocket is formed in the upper receiver and communicates with the charging handle channel, comprising:

a bolt;

at least one projection, one of said at least one projection makes contact with a wall of the cam pocket;

a gas key having at least one projection pocket formed in a bottom thereof, said at least one projection pocket is sized to slidably receive said at least one projection, said gas key is attached to a top of said bolt; and at least one biasing device forces said at least one projection beyond a side of said gas key, wherein said gas key is slidably retained in said charging handle channel.

9. The delayed blowback device of claim 8 wherein:

said at least one projection has a round shape.

10. The delayed blowback device of claim 8 wherein:

said at least one biasing device is a leaf spring.

11. The delayed blowback device of claim 10 wherein:
a threaded hole is formed in said gas key to threadably receive a threaded fastener, said threaded fastener is used to retain said leaf spring.

12. The delayed blowback device of claim 8 wherein:
said at least one projection has a D-shape.

13. The delayed blowback device of claim 12 wherein:
said at least one biasing device is a compression spring.

14. The delayed blowback device of claim 13 wherein:
a hole is formed in each one of said at least one projection to receive said compression spring.

* * * * *